United States Patent [19]

Dietrich et al.

[11] 4,032,869

[45] June 28, 1977

[54] RELAY WITH PIVOTING ARMATURE

[75] Inventors: Bernhard Dietrich, Eichenau; Anton Happach, Munich, both of Germany

[73] Assignee: Schaltbau Gesellschaft m.b.H., Munich, Germany

[22] Filed: Feb. 24, 1976

[21] Appl. No.: 660,918

[30] Foreign Application Priority Data

Apr. 15, 1975 Germany ..... 2516535

[52] U.S. Cl. ..... 335/132; 335/201; 335/203

[51] Int. Cl.² ..... H01H 67/02

[58] Field of Search ..... 335/132, 201, 202, 203

[56] References Cited

UNITED STATES PATENTS

| | | | |
|---|---|---|---|
| 3,701,062 | 10/1972 | Koga et al. | 335/202 X |
| 3,893,194 | 7/1975 | Hayden et al. | 335/203 X |

*Primary Examiner*—George Harris
*Attorney, Agent, or Firm*—Ralf H. Siegemund

[57] ABSTRACT

The non-electric portion of the relay is constructed in two part configuration, one part being a coil carrier having a flange with wall structure covered by the other part, a head piece. The head piece has partitions to define arc chambers and carries one set of contacts and blowing magnets on the outside, the wall structure of the flange carries the other set of contacts and establishes internally the pivot path for the armature on the flange. The parts have indexing means for positioning and are bolted together.

4 Claims, 4 Drawing Figures

RELAY WITH PIVOTING ARMATURE

BACKGROUND OF THE INVENTION

The present invention relates to a relay or electromagnetic switch particularly of the type having a pivoting armature.

Relays with pivoting armature are, for example, constructed in that a support body or member is provided and the various components, such as contacts, lead-ins, arc blowing means etc. are mounted to the body in proper relation and orientation to each other. The thus assembled unit is then covered. The cover may, for example, be constructed to establish an arc chamber, if the blowing means include e.g. a magnet.

The known construction has the disadvantage that in the case of a compact design some parts have to be placed very close on the support body rendering installation cumbersome, and repair and replacement is complicated accordingly, even impossible at times. For reasons of economics it is desirable to use the same kind of support member or body for different kinds of relays, contactors, switches, etc. with or without arc blowing, but in the past one still had to use quite frequently a differently designed support construction. Clearly, there is a need for a universal relay support structure.

DESCRIPTION OF THE INVENTION

It is an object of the present invention to construct a relay with pivoting armature, so that it can be assembled and disassembled rather easily, permitting also assembly in different configurations for different purposes.

In accordance with the preferred embodiment of the present invention, it is suggested to construct the relay from two basic elements, a coil carrier and a head piece, to which the electrically active parts are connected or fastened. The coil carrier has a mounting flange from which extends wall means with apertures for, preferably, releasibly connecting contacts of a first set; the head piece is fastened to the carrier and has partitions which extend towards the flange to establish arc chambers. The head piece has outside fastening means for receiving magnets for arc blowing; moreover, the head piece is also provided with apertures for connection of contacts of a second set. The armature of the relay is received in the cavity defined by the head piece and the flange and into which the contacts extend whereby specifically the flange is provided with guide surfaces for pivotally mounting the armature. The head piece as well as the flange may be provided with guide surfaces to facilitate assembly and correct placement of head piece and carrier for fastening. Only a few screws or bolts may be needed to fasten the parts to each other.

The contacts of at least one of the sets should be releasibly connected and one may, in cases, provide only one set of contacts cooperating with the armature for mere contact closing or opening. In the case of removing the blowing magnets, the relay may be used for a.c. Ribs may be provided to prevent engagement of and with wires which connect to the fastened contacts.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows an armature *a*, a relay coil carrier *b* and a head piece *c*. Parts *b* and *c* are made of plastic. The armature *a* is comprised of an armature plate 50, from which extends a tongue or nose 54. A central wall element 55 made e.g. of insulating material extends up from plate 50 (being bolted thereto or otherwise affixed). The wall 55 has a slot in which is placed an E-shaped contact element 51, of which the central leg is held in the slot, e.g. under spring bias. The outer legs of the E are the contact pieces proper. The top of wall 55 carries a contact piece 52. Guide elements 53 of curved configuration extend sideways from wall 55 and in the rear in relation to the nose 54.

Figure 1:
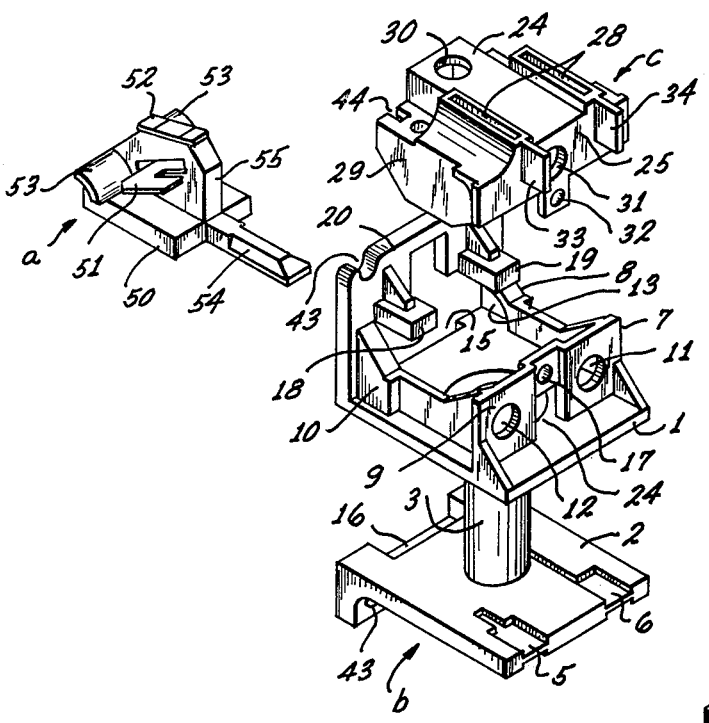
FIG. 1 is an exploded view of support structure as well as of the armature for a relay in accordance with the preferred embodiment of the invention.
Figure 2:
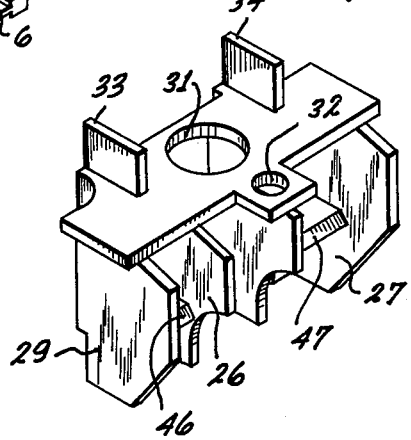
FIG. 2 is an isometric view of a head piece, already shown in FIG. 1, but from a different angle.

The coil carrier *b* is the basic body and support member and is comprised primarily of two plates or flanges 1 and 2 interconnected by a tubular post 3. The space around post 3 and between flanges 1 and 2 is provided to receive the relay coil (coil 4 in FIG. 3). Flange 2 is provided with two pairs, 5 and 6, of recesses for receiving connectors or the lead-ins to the coil.

Wall-like constructions 7, 8, 9 and 10 extend from the surface of flange 1 facing in direction opposite the post 3. The two wall elements 7 and 9 have respectively openings 11 and 12 for mounting stationary contact pieces. Together these elements 7 and 9 can be regarded as a front wall which is joined by a bridge 17 having an opening for receiving a bolt or a screw. The passage 24 underneath the bridge is provided for accomodating the nose 54 of the armature. The bridge 17 serves as an upward stop for that armature nose.

Elements 8 and 10 can be regarded as side walls, and they each have an approximately quarter-circle shaped recess, such as 13 of side wall 8, serving as guide surfaces or paths for the armature *a*. As stated, the armature is provided with curved guide elements or vanes 53 and the curved surface portion of the openings such as 13 serve as slide beds for these guide pieces 53.

The two flanges 1 and 2 are respectively provided with aligned recesses 15 and 16 to receive a yoke element 14 for holding the armature and for closing the magnetic circuit. The two side walls 8 and 10 are in the rear joined by a bridge element 20 having a gate-like opening through which can be shifted the armature center wall 55 upon insertion of the armature in the space as surrounded by the walls or flange 1.

Guide elements 18 and 19 extend inwardly from bridge 20. The extensions 18 and 19 of part *b* have triangularly shaped guides which will be received by slots 44 in head piece *c*. Parts or guide elements 18, 19 position the head piece *c* laterally. Reference numerals 43 refer to recesses and bores for fastening part *b* e.g. to a wall or the like.

Proceeding now to the description of head piece *c*, it has a front wall 25, a top 24 and side walls 27, 29. Two internal partitions 26 establish three chambers of which the outer two are provided to accommodate any arc. The head piece *c* has additionally more internally positioned transverse wall 46 and 47 to confine the arc chambers more fully. The chambers each have a curved roof and slit-like exits 28 in the top 24.

The outer side walls of head piece *c*, such as 29, but also 27, carry holders, such as 48 outlining a circle for holding disk-shaped permanent magnets to provide for blowing action of the relay. The magnetic axes of these magnets are centered to the contact path as between the outer legs of the E shaped contact 51 on armature *a* when inserted in the relay for making contact with stationary contacts when inserted in openings 11 and 12. It can be seen specifically that the magnets are to be mounted on the outside of the particular portion of the wall structure which, on the inside, establishes the arc chambers.

The front wall 25 has an opening 31 for fastening a contact piece e.g. a normally closed contact. An opening 30 in top 24 serves the same purpose for a second contact. The contacts when mounted (see FIG. 3) will cooperate and specifically they will normally be interconnected by the contact piece 52 of the armature, for unenergized relay coil.

The front wall 25 of head piece *c* has a lug 32 with a bore, which will be aligned with the bore in bridge 17 for fastening the head piece *c* to body *b*. Additional bores are provided for bolting head piece *c* to the extensions 18 and 19 (the bores in the latter have been omitted for the sake of clarity).

Head piece *c* has additionally two ribs 33, 34 for purposes of user protection, to prevent unintentional touching of the contact piece in opening 31 and when fastened to wall 25. Also, the ribs prevent accidental contact making among wires, which connect to the several contacts.

Figure 3:
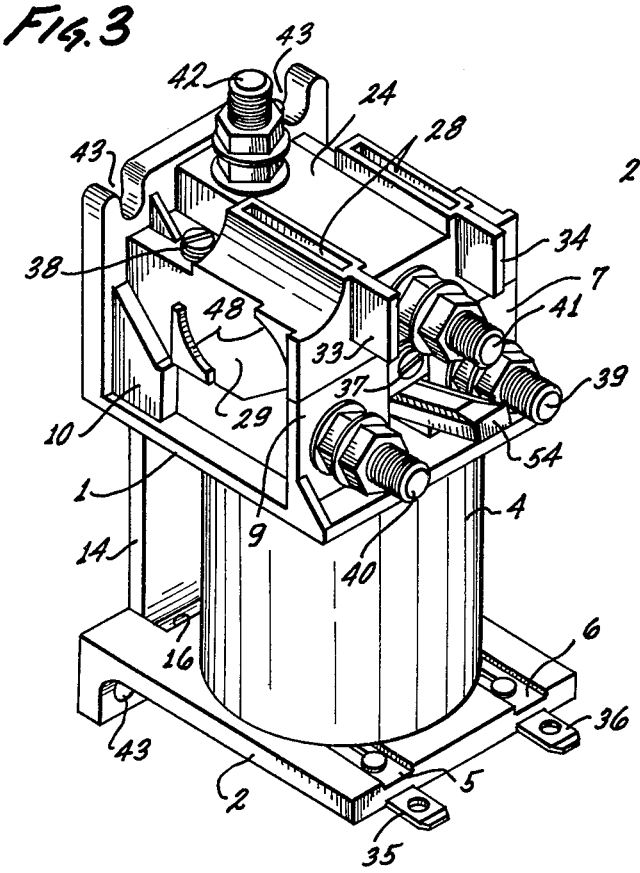
FIG. 3 is an isometric view of an assembled relay which includes the parts shown in FIGS. 1 and 2.
Figure 4:
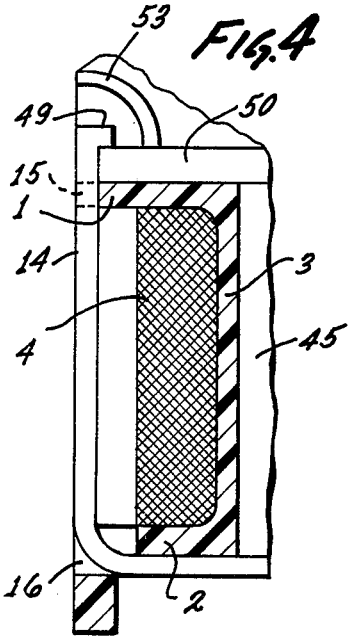
FIG. 4 is a cross-section through a detail of the assembled relay of FIG. 3.

FIG. 3 illustrates the assembled relay and FIG. 4 illustrates an internal portion of the assembly. The coil 4 is mounted around post 3 (no longer visible) and the wire ends of the coil are fastened to contact pieces 35 and 36. The hollow post 3 receives a core 45; one axial end of core 45 is accessible in the cavity or chamber as defined by the walls 7, 8, 9, etc. while the other end of the core engages the short end (not shown) of L-shaped yoke 14 which has been inserted in recesses 15 and 16. The yoke 14 has been bolted to the core 45.

The armature *a* has been placed into the space above flange 1 and its nose 54 projects through opening 24. An overhung ledge or ridge 49 of yoke 14 grips around near the rear of the armature plate 50 to retain the armature and hinge it when in position (see FIG. 4).

Bolts 37 and 38 fasten head piece *c* to body *b*, whereby bolt 37 traverses the opening 32 as aligned with the bore in bridge 17. The visible bolt 38 fastens a depressed portion of top 24 of head piece *c* to the piece 18. There is an analogous bolt for connecting the part 19 to the other recessed portion of the top 24 of head piece *c*.

The two contact pieces 39 and 40 have been respectively inserted in openings 11 and 12, and they have been releasably fastened to front wall portions 7 and 9. The other two contacts 41 and 42 have been respectively inserted in openings 31 and 30 and also releasibly fastened to the front wall 25 and top 24 of head piece *c* respectively.

The cavity between head piece *c* and flange 1 may also include a spring (not shown) which biases the armature *a* into an up position in which the contact piece 52 interconnects the contacts 41, 42. For energized relay coil, E-shaped contact 51 interconnects the contacts 39 and 40. Examples for contact arrangements in the vicinity of the armature and other details of the armature are disclosed by way of example in the copending application of one of us (common assignee) Ser. No. 631,745 filed Nov. 13, 1975.

It can readily be seen that the construction of the relay simplifies installation greatly. The parts can readily be separated by removing bolts 37, 38. The relay construction can be used for providing e.g. for more contact opening and closing in which case contacts are not connected e.g. to the head piece *c*. Also, the magnets in holders 48 can simply be removed for operating the relay with a.c. The armature can simply be shifted onto flange 1, underneath bridge 20. The contacts can be mounted to parts *b* and *c* separately before these parts are bolted together.

The invention is not limited to the embodiments described above, but all changes and modifications thereof not constituting departures from the spirit and scope of the invention are intended to be included.

We claim:

1. In a relay with pivoting armature and first and second contact means cooperating with the armature, a two part support structure comprising:

a coil carrier with a rectangular flange from which extends wall means with apertures for receiving the first set of contacts, the wall means having guide surfaces for support of pivot motion of the armature; and a head piece being fastened to said carrier adjacent said flange having apertures for receiving the second set of contacts, further having partition means extending towards said flange, the head piece having outside wall means with holders for magnets, which if placed in the holders provide for magnetic blowing.

2. In a relay as in claim 1 and including means on the carrier and the head piece for orienting them in relation to each other for fastening.

3. In a relay as in claim 1, wherein the contacts of at least one of said sets are releasably mounted.

4. In a relay as in claim 1, the head piece including outwardly extending ribs, extending between contacts of the sets.

* * * * *